US006705133B1

(12) United States Patent
Avganim

(10) Patent No.: US 6,705,133 B1
(45) Date of Patent: Mar. 16, 2004

(54) LAPTOP LOCK

(76) Inventor: Alexander G. Avganim, P.O. 446, Sderot, 80100 (IL)

( * ) Notice: Subject to any disclaimer, the term of this patent is extended or adjusted under 35 U.S.C. 154(b) by 0 days.

(21) Appl. No.: 09/694,008

(22) Filed: Oct. 23, 2000

(51) Int. Cl.[7] ..... E05B 73/00

(52) U.S. Cl. ..... 70/14; 70/18; 70/58; 70/62; 70/360; 248/316.4; 248/553

(58) Field of Search ..... 70/14, 18, 19, 70/58, 62, 100, 129, 360, 361; 248/553, 316.4, 231.41, 74.4; 292/150

(56) References Cited

U.S. PATENT DOCUMENTS

| | | | | | |
|---|---|---|---|---|---|
| 1,851,313 | A | * | 3/1932 | Johnson | |
| 2,931,607 | A | * | 4/1960 | McFarland | |
| 3,970,196 | A | * | 7/1976 | Legge | 211/5 |
| 4,003,228 | A | * | 1/1977 | Lievens et al. | 70/58 |
| 4,212,175 | A | * | 7/1980 | Zakow | 70/58 |
| 4,326,747 | A | * | 4/1982 | Finnegan | 70/19 X |
| 4,591,127 | A | * | 5/1986 | Tuvesson | 248/551 |
| 4,949,559 | A | * | 8/1990 | Glines | 70/19 |
| 5,040,545 | A | * | 8/1991 | Dutcher et al. | 70/19 X |
| 5,154,072 | A | * | 10/1992 | Leyden | 70/18 |
| 5,502,989 | A | | 4/1996 | Murray, Jr. et al. | 70/58 |
| 5,881,582 | A | * | 3/1999 | Monaco | 70/14 |
| 6,006,557 | A | | 12/1999 | Carl et al. | 70/58 |
| 6,167,734 | B1 | * | 1/2001 | Derman | 70/18 |
| 6,308,928 | B1 | * | 10/2001 | Galant | 70/58 X |

FOREIGN PATENT DOCUMENTS

| | | | | |
|---|---|---|---|---|
| FR | 1066268 | * | 6/1954 | 70/58 |
| IL | 120090 | | 1/1997 | |
| WO | WO98/32939 | * | 7/1998 | |

* cited by examiner

*Primary Examiner*—Lloyd A. Gall
(74) *Attorney, Agent, or Firm*—Ostrolenk, Faber, Gerb & Soffen, LLP

(57) ABSTRACT

A laptop lock for securing portable computers and the like against theft with an entrapment mechanism for securing one or more cables, cords, wires, or the like, which is adaptable for locking the one or more cables, cords, wires, or the like to a base.

14 Claims, 6 Drawing Sheets

LAPTOP LOCK

BACKGROUND OF THE INVENTION

1. Field of Invention

The present invention relates to locks. More particularly, the present invention relates to locks suitable for securing small, portable components, such as desktop or laptop computers or related components.

2. Description of Related Art

Due to the small size of many modern electrical components, such as computers and other electronic devices, a great concern exists for the physical security of such components. For example, in the office or commercial environment, the threat of theft of such electronic devices is high, due to both the relatively high cost of the components, and the ease with which they can be concealed. A need has therefore been present in the art for means to secure the electronic or other components, to prevent theft and/or loss of the components.

A problem with securing such items, however, is the general lack of a conventional means to secure the components. For example, one approach in the past has been to use a bicycle-type locking device, where a locking cable is passed through a suitable holding means on the electronic component as well as to a suitable solid support, such as a desk. This has the result of effectively "tying down" the device to the solid support. However, this approach has become less suitable, as the size of the electronic components continue to decrease and the demand for more convenient locking systems has increased.

Many models of portable computers today are equipped with safety means. The safety means usually includes a standardized slot on an outer wall or housing of the computer. A variety of locking devices, generally with steel cables attached to the locking devices, have been developed for the attachment and disengagement thereof to such slots.

Conventional locking devices use a T-shaped spindle and tumble design. The T-shaped spindle is inserted into a releasable locking element. However, the T-shaped spindle is separately detachable from the locking element, thus increasing the possibility of losing the T-shaped spindle. Furthermore, the attachment of the T-shaped spindle to the locking element can be complicated as two isolated structures must be precisely combined.

SUMMARY OF THE INVENTION

The present invention provides a locking arrangement for securing portable computers and the like against theft.

The invention separately provides a unified and compact locking arrangement equally applicable to both slotted and non-slotted structures.

In one exemplary embodiment, the present invention is a laptop lock for securing portable computers and the like against theft with an entrapment for securing one or more cables, wires or the like, which is adaptable to a lock for locking the cable, wire or the like located within the entrapment to a base.

These and other features and advantages of this invention are described in or are apparent from the following detailed description of the preferred embodiments.

BRIEF DESCRIPTION OF THE DRAWINGS

Various exemplary embodiments will be described in detail, with reference to the following figures, wherein.

DETAILED DESCRIPTION OF PREFERRED EMBODIMENTS

In general terms, the present invention relates to a lock, or a locking system or locking method, which helps to prevent theft of small components, such as portable or even desktop computers, peripherals, or the like. The lock in several embodiments herein preferably includes a lock, which is adapted to include an entrapment mechanism or entrapment means.

Any suitable lock can be used in the lock of the present invention. Thus, for example, the lock can be any of the locks separately described herein. Alternatively, particularly when used in conjunction with the entrapment means, the lock can be any of the various known or after-developed locks, suitable for securing portable computers and the like.

The entrapment mechanism or entrapment means generally provides an adjustable housing or space that can entrap various objects. Thus, for example, the entrapment mechanism or entrapment means provides a housing or void that can be adjusted from a closed position, which provides a restricted space to thereby secure the object, to an open position, which is either completely open (i.e., is unrestricted), or is open to an extent to permit the object to be inserted into the defined housing.

The entrapment mechanism or entrapment means can, for example, be used to entrap one or more cords, wires and/or cables associated with the equipment to be secured by the lock in general, to thereby provide an added measure of security. Such cords, wires and/or cables can include, for example, but are not limited to, power cords, peripheral connection cords, cables, and/or wires, such as printer cables, speaker wires, mouse cords, joystick cords, lightpen cords, video feed cords, telephone cord, and the like. For ease of reference, these cords, cables, wires and the like are referred to herein generically as "cords" unless otherwise stated. The entrapment mechanism or entrapment means thereby provides increased security by preventing, or at least deterring, theft of the associated components because the respective cord, cable or wire would otherwise have to be cut to remove the component.

Thus, while the present invention is illustrated with respect to the following specifically described locks and locking mechanisms, the present invention is in no way limited to the structures described below.

Figure 1:
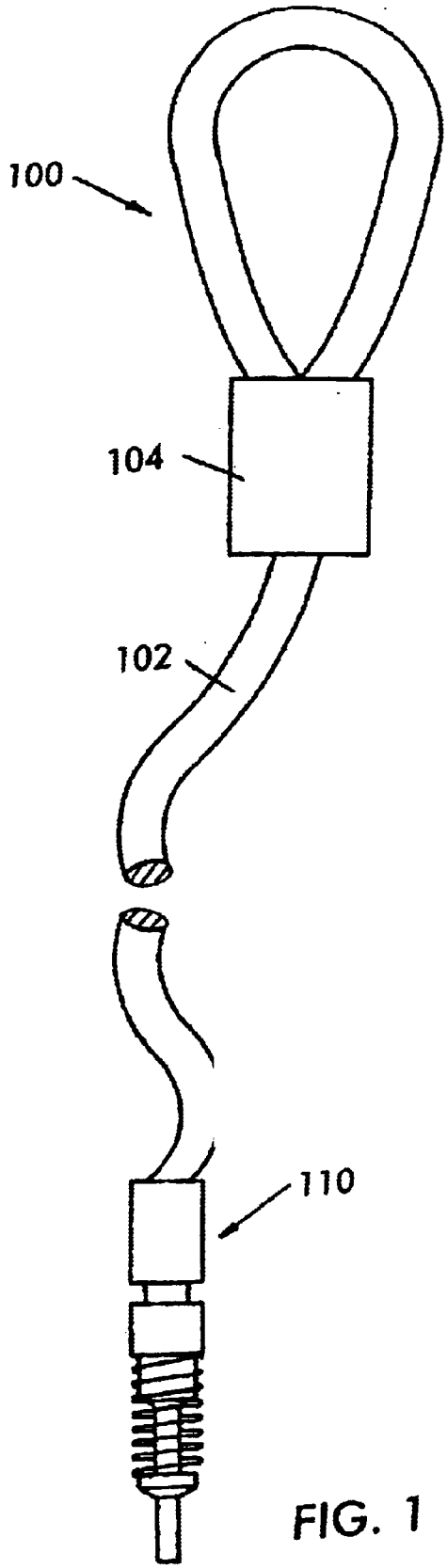
FIG. 1 is a perspective view of a cable apparatus.

FIG. 1 illustrates a first exemplary embodiment of the cable apparatus 100 according to this invention. As shown in FIG. 1, the cable apparatus 100 includes a cable 102. The cable apparatus 100 also includes a cable box 104. The cable box 104 is designed such that one end of the cable 102 is attached to the cable box 104 with the cable 102 extended so as to form a loop at one end of the cable box 104. The cable 102 thereafter extends through the cable box 104 to another side of the cable box 104.

Although depicted and referred to as a cable box, the cable box 104 need not be a solid box. Rather, in embodiments of the present invention, the cable box 104 can be any suitable means for securing one end of the cable 102 to another portion of the cable 102 so as to form a loop in the cable 102. Thus, for example, the cable box 104 can include any suitable means for connecting the cable portions, including a welded joint, a rivet, a taped or adhesively joined connection, or the like. The cable box 104 should, however, be a joining or connection mechanism that cannot be readily disengaged, as this would compromise the safety features of the lock in general.

The cable wire apparatus 100 further includes a cable plug 110 attached to the other end of the cable 102. The cable 102 can be attached to the cable plug 110 by any conventional means currently available or later developed.

Figure 2:
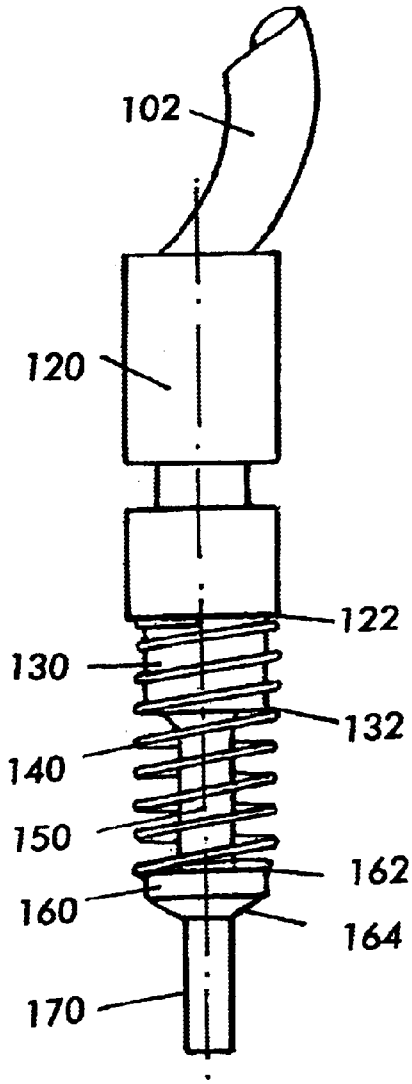
FIG. 2 is an exploded view of the cable plug of FIG. 1.

As shown in FIG. 2, the cable 102 is attached to a head 120 of the cable plug 110. The head 120 further comprises a surface 122. Attached to or integral with the surface 122 is a collar 130. The collar 130 has an outside diameter smaller than the outside diameter of the head 120. The collar 130 further comprises a surface 132. Attached to or integral with the surface 132 is a stem 150. The stem 150 has an outside diameter smaller than the outside diameter of the collar 130. Attached to or integral with the stem 150 is a collar 160. The collar 160 has a surface 162 attached to the stem 150 and a surface 164. The collar 160 has an outside diameter larger than the outside diameter of the stem 150. Included between the surface 122 of the head 120 and the surface 162 of the collar 160 is a spring 140. The spring 140 has an inside diameter larger than both the outside diameter of the collar 130 and stem 150, but smaller than the outside diameter of the head 120 and collar 160. Further attached to or integral with the surface 164 of the collar 160 is a stem 170. The stem 170 has an outside diameter less than the outside diameter of the collar 160.

While the cable plug 110 has been described as having a circular shape, it should be appreciated that the cable plug 110 can be of any desired shape with the proportional dimensioning as described above.

Figure 3:
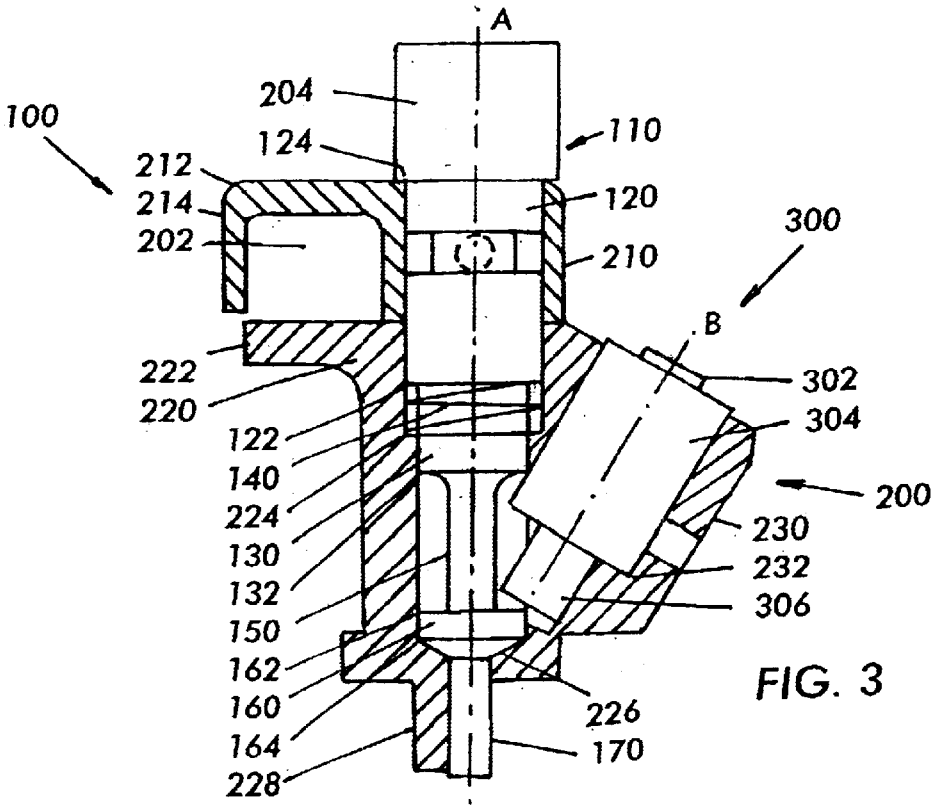
FIG. 3 is a plane view of a lock body with cable plug while in the locked state.
Figure 4:
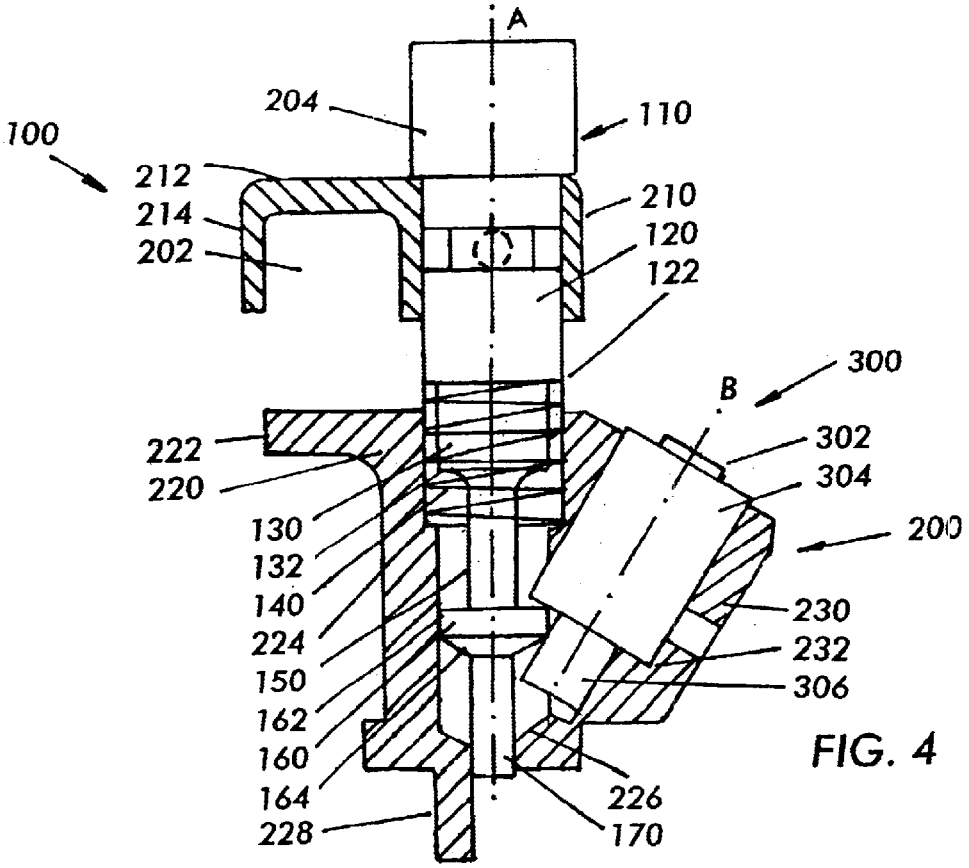
FIG. 4 is a plane view of a lock body and cable plug while in the unlocked state.

FIGS. 3 and 4 show a laptop lock 100 with the cable plug 110 inserted into the lock body 200. FIG. 3 is an exemplary embodiment of the cable plug 110 and lock body 200 in a locked position with lock 300. FIG. 4 is an exemplary embodiment of the cable plug 110 and lock body 200 in an unlocked position with lock 300.

The lock body 200 includes a first body 210, a second body 220 and a third body 230. The first body 210 and second body 220 surround the cable plug 110 and the third body surrounds the lock 300.

The first body 210 has an inside diameter larger than the outside diameter of the head 120. In various exemplary embodiments, a head 204 is attached to or integral with a surface 124 of the head 120 so as to prevent the first body 210 from extending beyond the cable plug 110. Head 204 has an outside diameter larger than the inside diameter of the first body 210. The first body 210 further comprises a first arm 212 that extends away from the inside diameter of the first body 210. The first body 210 further comprises a second arm 214 attached to the outside diameter of the first arm 212. The second arm 214 extends toward the second body 220.

The second body 220 of the lock body 200 has a first inside diameter larger than the outside diameter of the head 120. The second body 220 also has an arm 222. The arm extends away from the first inside diameter of the second body 220. The second body 220 also has a second inside diameter larger than the collar 130 and collar 160, but smaller than the first diameter. The diameter difference between the first diameter and second diameter form a lip 224. The second body 220 also has a third diameter larger than the outside diameter of stem 170 and smaller than the second diameter. The diameter difference between the second diameter and third diameter form a surface 226. The second body 220 further comprises an arm 228. The arm 228 extends away from the interior of the second body 220. The arm 228 is capable of being inserted into a standard slot in the outer wall of a computer (not shown).

The third body 230 of the lock body 200 is attached to the second body 220. The third body 230 has a first inside diameter larger than the outside diameter of the lock 300.

The lock 300 includes a body 304 with a push button 302 located at one end of the body 304 and a detent 306 located at another side of the body 304. The lock 300 is located such that the push button 302 appears from the outside of the third body 230 and the body 304 and detent 306 extend into the second diameter of the second body 220. The lock 300 is a standard locking device with a push button 302 capable of moving the detent 306 along the B axis. In various exemplary embodiments, the third body 230 has a second inside diameter less than the outside diameter of the body 304 and greater than the outside diameter of the detent 306. The difference between the first diameter and the second diameter of the third body 230 thus forms a lip 232 on which the body 304 of the lock 300 rests.

As shown in FIGS. 3 and 4, the cable plug 110 is inserted into the lock body 200. The cable plug 110 is restricted in its movement along the A axis by the surface 164 of the collar 160 coming into contact with the surface 226 of the second body 220. The cable plug 110 is also restricted along the A axis by the surface 162 of the collar 160 coming into contact with the body 304 extending into the second diameter of the second body 220.

As shown in FIG. 4, the laptop lock 100 is in an unlocked state. The body 304 is in contact with the surface 162 of the collar 160 and the detent 306 is in contact with the surface 164 of the collar 160 so as to restrict axial movement of the cable plug 110 along the A axis. Also, the first body 210 is off-set from the second body 220.

When moving into a locked state as shown in FIG. 3, the lock 300 is unlocked such that the push button 302 is moved away from the cable plug 110. Consequently, the detent 306 also moves away from the cable plug 110 so that the collar 160 can move within the second diameter of the second body 220. The first body 210 is then moved toward the second body 220 along the A axis until the surface 164 of the collar 160 comes into contact with the surface 226 of the second body 220. As should be appreciated, the arm 214 of the first body 210 comes into close proximity with the arm 222 of the second body so as to create an area 202. The area 202 thus created is such that objects placed within the area 202 when in the unlocked state are prevented from escaping while the laptop lock 10 is in the locked state. It should also be appreciated that as the first body 210 moves toward the second body 220, the spring 140 contracts as the movement of the spring 140 is limited by the lip 224 and the surface 122 of the head 120 so as to create potential energy within the spring 140.

By forming the area 202, the laptop lock of the present invention can be used not only to secure the cable to the laptop housing, but it can also be used to entrap cables, wires, or the like, as discussed above. Thus, for example, the laptop lock can be used to further secure computer equipment by entrapping a power cord or peripheral cable, such as a monitor cable, mouse cable, printer cable, telephone cord or the like, within the space 202. Preferably, the area 202 should be sized so that it is big enough to permit entrapment of the cable or wire therein, while still permitting proper locking of the lock. At the same time, the area 202 should also be sized so that it is small enough to prevent an end of the entrapped cable or wire from being pulled through the area 202. Thus, for example, the area 202 should be big enough to allow free entrapment of a power cord, but should be small enough that the plug cannot be pulled through the area when the lock is in the locked state.

Once the surface 164 of the collar 160 comes in contact with the surface 226 of the second body 220, the push button 302 is moved along the B axis such that the detent 306 comes into contact with the surface 162 of the collar 160. Once the detent 306 comes into contact with the surface 162 of the collar 160, the lock 300 locks the detent 306 in position such that the detent 306 prevents the cable plug 110 from moving along the A axis.

When moving back to the unlocked state as shown in FIG. 4, an unlocking mechanism is applied to the lock 300 such that the push button 302 moves out along the B axis. As the push button 302 moves along the B axis, the detent 306 moves away from the surface 162 of the collar 160. Once the detent 306 moves away from the surface 162 of the collar 160, the potential energy stored in the spring 140 forces the cable plug 110 along the A axis. As the cable plug 110 moves along the A axis, the arms 212 and 214 of the first body 210 move away from the arm 222 of the second body 220. As such, an open area 202 is created such that objects can be removed from the area 202. The cable plug 110 moves along the A axis until the surface 162 of the collar 160 comes into contact with the body 304 that extend into the second diameter of the second body 220. Thereafter, the push button 302 can be moved along the B axis such that the detent 306 comes into contact with the surface 164 of the collar 160 so as to restrict axial movement of the cable plug 110 along the A axis.

Figure 5:
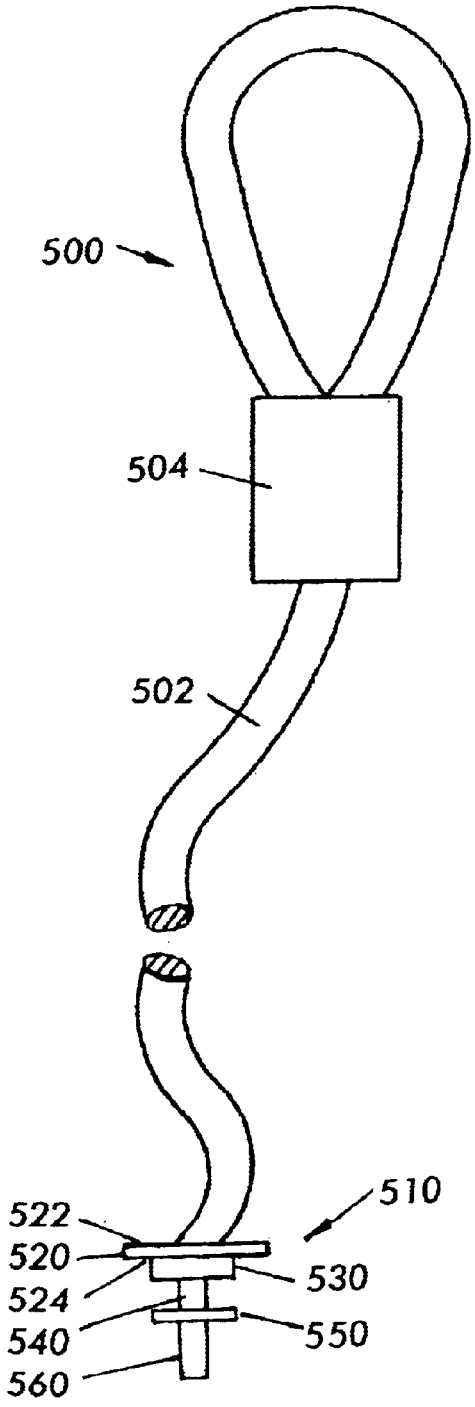
FIG. 5 is a perspective view of a cable apparatus.

FIG. 5 illustrates a second exemplary embodiment of the cable apparatus 500 according to this invention. As shown in FIG. 5, the cable apparatus 500 includes a cable 502. The cable apparatus 500 also includes a cable box 504. The cable box 504 is designed such that one end of the cable 502 is attached to the cable box 504 with a cable 502 extended so as to form a loop at one end of the cable box 504. The cable 502 thereafter extends through the cable box 504 to another side of the cable box 504.

Although depicted and referred to as a cable box, the cable box 504 need not be a solid box. Rather, in the embodiments of the present invention, the cable box 504 can be any suitable means for securing one end of the cable 502 to another portion of the cable 502 so as to form a loop in the cable 502. Thus, for example, the cable box 504 can include any suitable means for connecting the cable portions, including a welded joint, a rivet, a taped or adhesively joined connection, or the like. The cable box 504 should, however, be a joining or connection mechanism that cannot be readily disengaged, as this would compromise the safety features of the lock in general.

The cable wire apparatus 500 further includes a cable plug 510 attached to the other end of the cable 502. The cable 502 can be attached to the plug 510 by any conventional means currently available or later developed.

As shown in FIG. 5, the cable 502 is attached to a head 520 of the cable plug 510. The head 520 further comprises a first surface 522 and a second surface 524. Attached to or integral with the second surface 524 is a collar 530. The collar 530 has an outside diameter smaller than the outside diameter of the head 520. Attached to or integral with the collar 530 is a stem 540. The stem 540 has an outside diameter smaller than the outside diameter of the collar 530. Attached to or integral with the stem 540 is a collar 550. The collar 550 has an outside diameter larger than the outside diameter of the stem 540. Attached to or integral with the collar 550 is a stem 560. The stem 560 has an outside diameter less than the outside diameter of the collar 550.

While the cable plug 510 has been described as having a circular shape, it should be appreciated that the cable plug 510 can be of any desired shape with the proportional dimensioning as described above.

Figure 6:
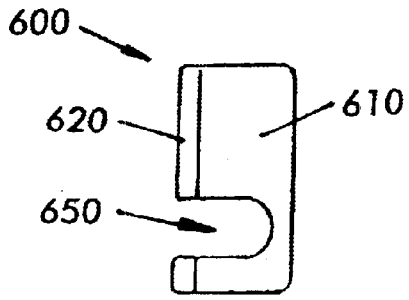
FIG. 6 is a side view of a clamp.
Figure 7:
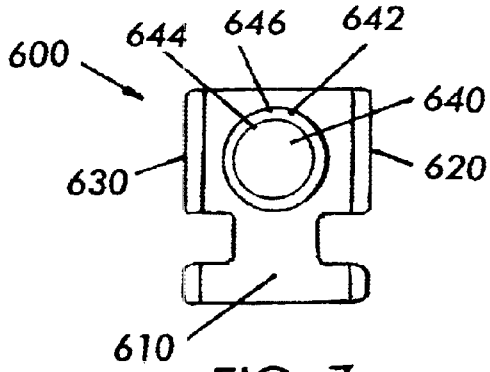
FIG. 7 is a front view of the clamp of FIG. 6.
Figure 8:
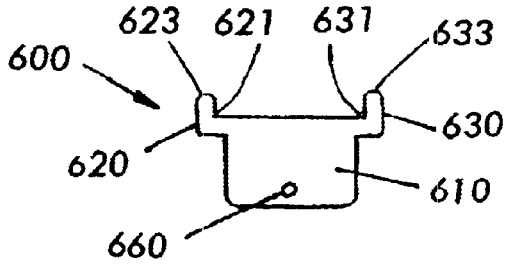
FIG. 8 is a top view of the clamp of FIG. 6.
Figure 9:
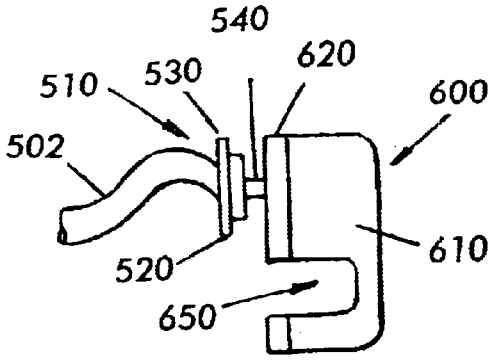
FIG. 9 is a side view of the cable apparatus and clamp.

FIGS. 6–8 illustrate a second exemplary embodiment of a clamp 600 according to this invention and FIG. 9 illustrates a first exemplary embodiment of the cable apparatus 500 and clamp 600. As shown in FIGS. 6–8, the clamp 600 includes a body 610. Attached to the body 610 is a left ridge 620 and a right ridge 630. Each of the left ridge 620 and right ridge 630 have a first arm 621, 631 extending away from the interior of the body and a second arm 623, 633 extending from the first arm and away from the outside surface of the body 610.

The clamp 600 also includes an opening 640. The opening 640 has a cylindrical shape through the body 610. The opening 640 also has a first diameter 644 extending through the entire body 610 with a diameter larger than the outside diameter of the collar 530 but smaller than the head 520 so as to insert the collars 530 and 550 and stems 540 and 560 through the body 610 and to restrict axial movement of the head 520. The opening 640 further includes a second diameter 646 extending a substantial distance but not entirely through the body 610. The second diameter 646 is larger than the first diameter 644 and the outside diameter of the head 520. The second diameter 646 is larger than the head 520 so as to insert the head 520 through the opening 640 but the head is unable to pass through the entire body 610. The diameter difference between the first diameter 644 and second diameter 646 thus creates a ledge 642 so as to rest the second surface 524 of the head 520 against the ledge 642.

The clamp 600 further comprises an opening 660. The opening 660 is provided so as to insert an object through the body 610.

The clamp 600 further includes an opening 650. The opening 650 extends through the body 610 at the opposite end of opening 640.

As should be appreciated in FIG. 9, the cable apparatus 500 is inserted into the clamp 600. An object is then inserted into the opening 650 so as to extend inward past the outside diameter of the head 520 at the first surface 522. The axial movement of the cable apparatus 500 is thus limited by the object inserted through the opening 650 coming into contact with the first surface 522 of the head 520 and the ledge 642 coming into contact with the second surface 524 of the head 520.

Figure 10:
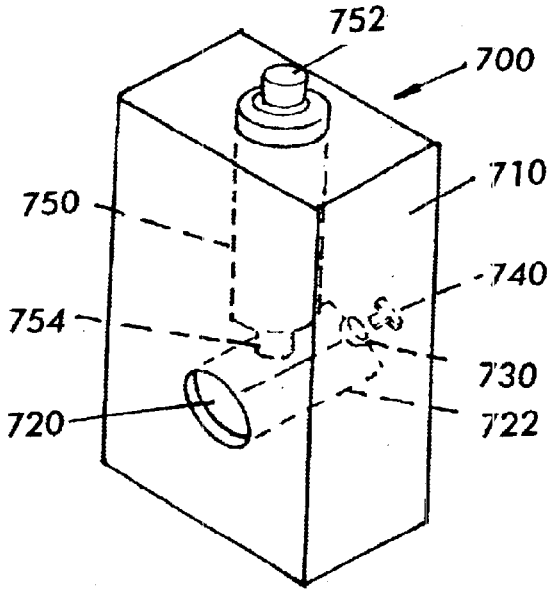
FIG. 10 is a front view of the lock body.
Figure 11:
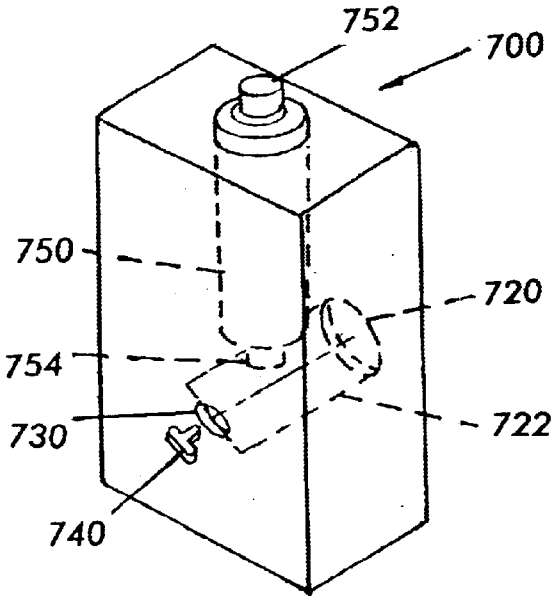
FIG. 11 is a back view of the lock body of FIG. 10.

FIGS. 10 and 11 illustrate a second exemplary embodiment of a lock body 700 according to this invention. As shown in FIGS. 10 and 11, the lock body 700 includes a body 710. At one surface of the body 710 is a first opening 720 with a cylindrical body 722 extending through the body 710. The opening 720 and cylindrical body 722 have a diameter larger than the outside diameter of the collar 530. Thus, it should be appreciated that the collar 530 and 550 and stem 540 and 560 can be inserted through the opening 720 and the cylindrical body 722 of the body 710. At the other surface of the body 710 is a second opening 730. The second opening 730 has an inside diameter larger than the outside diameter of the stem 560 so as to allow the stem 560 to pass through the second opening 730 but smaller than the outside diameter of the collar 550. Thus, it should be appreciated that axial movement of the cable apparatus 500 is restricted as the collar 550 comes into contact with the body 710.

The lock body 710 further comprises an arm 740 extending away from the lock body 710 so as to be inserted into a center slot in the outer wall of a computer (not shown).

The lock body 710 further comprises a lock 750. The lock 750 includes a push button 752 located at one end of the lock 750 and a detent 754 located at the other end of the lock 750. The lock 750 is located such that the push button 752 appears from the outside of the lock body 700 and the detent 754 extends into the cylindrical body 722. The lock 750 is a standard locking device with a push button 752 capable of moving the detent 754.

Figure 12:
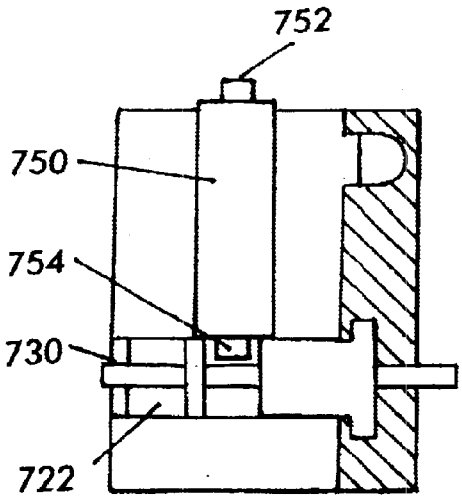
FIG. 12 is a plane view of the lock body, clamp and cable apparatus in the locked state.

When moving into a locked state as shown in FIG. 12, the lock 700 is unlocked such that the pushbutton 702 is moved away from the lock body 700. Consequently, the detent 754 moves outside of the cylindrical body 722 so that the collar 530 and 540 and stem 550 and 560 can move throughout the cylindrical body 722. The cable apparatus is then moved through the cylindrical body 710 until the collar 550 comes into contact with the second opening 730 of the body 710. As the cable apparatus 500 moves through the cylindrical body 722, the left ridge 620 and the right ridge 630 of the clamp 600 surrounds the lock body 700 as the body 610 of the clamp 600 comes into contact with the body 710 of the lock body 700. As should be appreciated, the body 710 closes the opening 650 such that objects placed within the opening 650 are prevented from escaping.

By closing the opening 650, the laptop lock of the present invention can be used not only to secure the cable to the laptop housing, but also can be used to trap cables, wires, or the like. Thus, for example, the laptop lock can be used to further secure computer equipment by entrapping a power cord a peripheral cable, such as a monitor cable, mouse cable, printer cable, telephone cord or the like, within the opening 650.

Once the collar 550 comes into contact with the second diameter 730, the push button 702 extends into the cylindrical body 722 such that the detent 754 is between the collar 530 and collar 550. Once the detent 754 extends between the collar 530 and the collar 550, the lock 700 locks the detent 754 in position such that the detent 754 prevents the cable plug 510 from moving as it comes into contact with collar 530 and collar 550.

When moving back to the unlocked state, a locking mechanism is applied to the lock 700 such that the push button 702 is then moved away from the lock body 700. As the push button 702 moves, the detent 754 moves away from the cylindrical body 722. Once the detent 754 moves away from the cylindrical body 722 the cable apparatus 500 is thereafter able to move through the opening 720. As such, the opening 650 is opened as the clamp 600 moves away from the lock.

Figure 13:
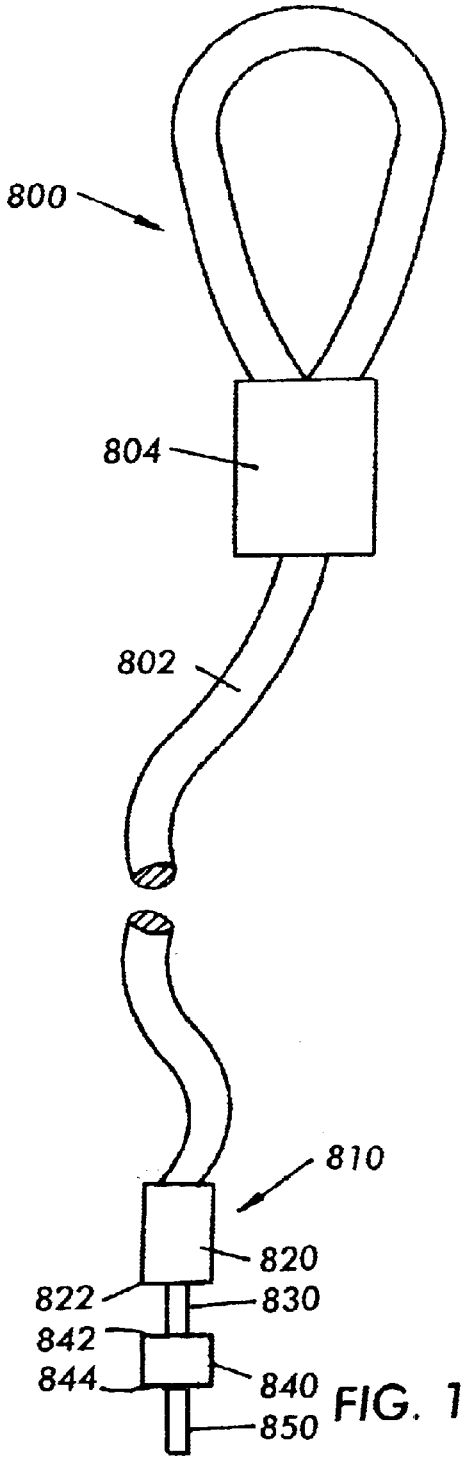
FIG. 13 is a perspective view of a cable apparatus.

FIG. 13 illustrates a third exemplary embodiment of a cable apparatus 800 according to this invention. As shown in FIG. 13, the cable apparatus 800 includes a cable 802. The cable apparatus 800 also includes a cable box 804. The cable box 804 is designed such that one end of the cable 802 is attached to the cable box 804 with the cable 802 extended so as to form a loop at one end of the cable box 804. The cable 802 thereafter extends through the cable box 804 to another side of the cable box 804.

Although depicted and referred to as a cable box, the cable box 804 need not be a solid box. Rather, in embodiments of the present invention, the cable box 804 can be any simple means for securing one end of the cable 802 to another portion of the cable 802 so as to form a loop in the cable 802. Thus, for example, the cable box 804 can include any suitable means for connecting the cable portions, including a welded joint, a rivet, a taped or adhesively joined connection, or the like. The cable box 804 should, however, be a joining or connection mechanism that cannot be readily disengaged, as this would compromise the safety features of the lock in general.

The cable apparatus 800 further includes a cable plug 810 attached to the other end of the cable 802. The cable 802 can be attached to the plug 810 by any conventional means currently available or later developed.

As shown in FIG. 13, the cable 802 is attached to a head 820 of the cable plug 810. The head 820 further comprises a surface 822. Attached to or integral with the surface 822 is a stem 830. The stem 830 has an outside diameter smaller than the outside diameter of the head 820. Attached to or integral with the stem 830 is a collar 840. The collar 840 has an outside diameter larger than the outside diameter of the stem 830. The collar 840 further comprises a first surface 842 and a second surface 844. Attached to or integral with the second surface 844 of the collar 840 is a stem 850. The stem 850 has an outside diameter less than the outside diameter of the collar 840.

While the cable plug 810 has been described as having a circular shape, it should be appreciated that the cable plug 810 can have any desired shape with the proportional dimension as described above.

Figure 14:
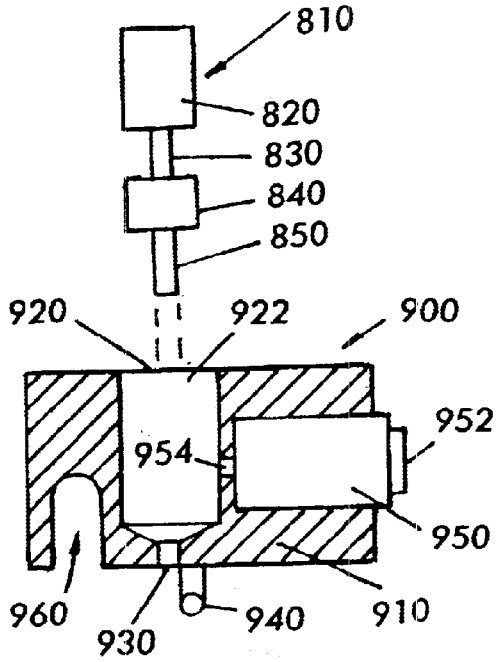
FIG. 14 is a plane view of a lock body with cable plug.

FIG. 14 illustrates a third exemplary embodiment of a lock body 900 according to this invention. As shown in FIG. 14, the lock body 900 includes a body 910. At one surface of the body 910 is a first opening 920 with a cylindrical body 922 extending through the body 910. The opening 920 has a cylindrical body 922 having a diameter larger than the outside diameter of the head 820. Thus, it should be appreciated that the cable plug 810 can be inserted through the opening 920 and the cylindrical body 922 of the body 910. At the other surface of the body 910 is a second opening 930, the second opening 930 having an inside diameter larger than the outside diameter of the stem 850 so as to allow the stem 850 to pass through the second opening 930 but smaller than the outside diameter of the collar 840. Thus, it should be appreciated that the axial movement of the cable apparatus 800 is restricted as the collar 840 comes into contact with the body 910.

Lock body 910 further comprises an arm 940 extending away from the lock body 910 so as to be inserted into a center slot in the outer wall of a computer (not shown).

The lock body 910 further comprises a lock 950. The lock 950 includes a push button 952 located at one end of the lock 950 and a detent 954 located at the other end of the lock 950. The lock 950 is located such that the push button 952 appears from the outside of the lock body 900 and the detent 954 extends into the cylindrical body 922. The lock 900 is a centered locking device with a push button 952 capable of moving the detent 954.

The lock body 900 further comprises an opening 960. The opening 960 located on the surface of the lock body 910 that includes the second opening 930 and arm 940 with the opening 960 extending through the body 910.

When moving into a locked state, the lock 900 is unlocked such that the push button 952 is moved away from the lock body 900. Consequently, the detent 954 moves outside of the cylindrical body 922 so that the cable plug 810 moves through the cylindrical body 922. The cable apparatus 810 is then moved through the cylindrical body 910 until the collar 840 comes into contact with second opening 930 of the body 910.

As should be appreciated, as the cable apparatus 800 is placed inside of the lock body 900, the arm 940 is inserted into the center slot and the outer wall of the computer. As the arm 940 is inserted into the center slot in the outer wall of the computer, the outer wall of the computer closes the opening 960 of the lock body 910. By closing the opening 960, the laptop lock of the present invention can be used not only to secure the cable to the laptop housing, but also can be used to trap cable, wires, and the like. Thus, for example, the laptop lock can be used to further secure computer equipment by entrapping a power cord, a peripheral cable, such as a monitor cable, mouse cable, printer cable, telephone cord or the like, within the opening 960.

Once the collar 840 comes into contact with the second diameter 930, the push button 952 extends into the cylindrical body 922 such that the detent 954 is between the head 820 and collar 840. Once the detent 954 extends between the head 820 and lock 900 locks detent 954 in position.

When moving back to the unlocked state, a locking mechanism is applied to the lock 900 such that the push button 952 is then moved away from the lock body 900. As the push button 952 moves, the detent 954 moves away from the cylindrical body 922. Once the detent 954 moves away from the cylindrical body 922, the cable apparatus thereafter able to move through the opening 920. As such, the opening 960 is open as the lock body 900 is able to move away from the outer wall of the computer.

Figure 15:
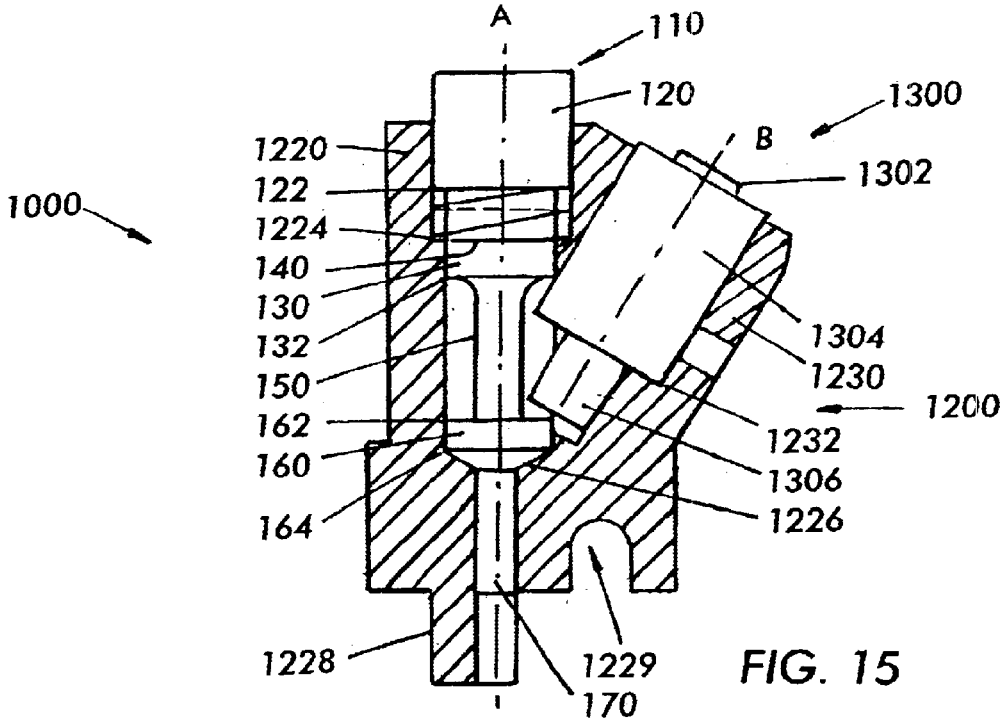
FIG. 15 is a plane view of a lock body with cable plug while in the locked state.
Figure 16:
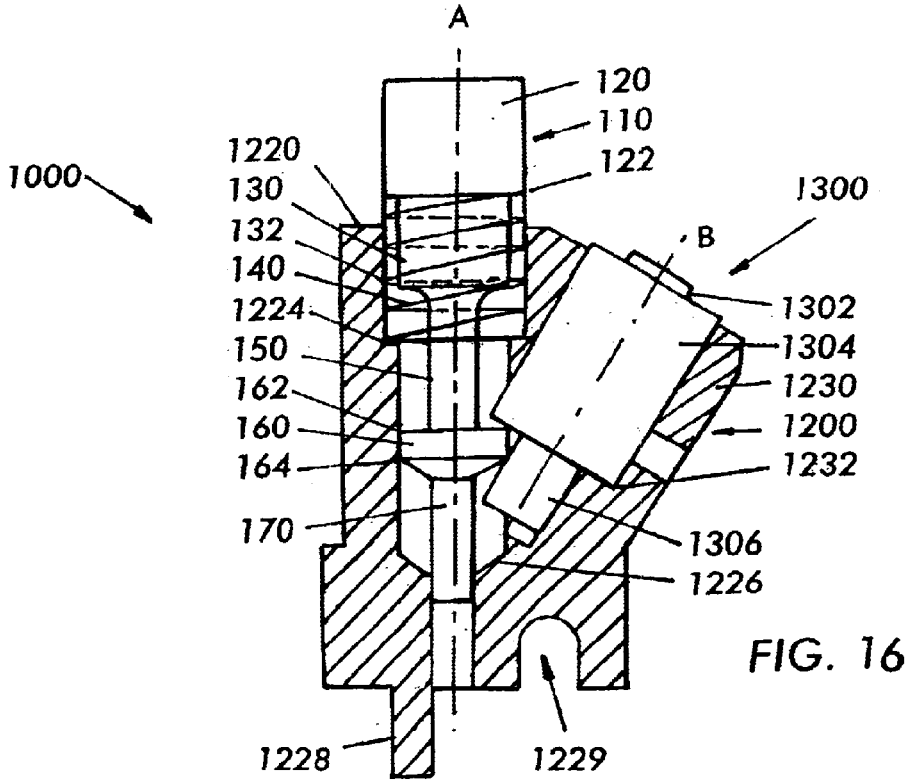
FIG. 16 is a plane view of a lock body with cable plug while in the unlocked state.

FIGS. 15 and 16 shows a fourth exemplary embodiment of a laptop lock 1000 with the cable plug 100 as shown in FIGS. 1 and 2 inserted into the lock body 1200. FIG. 15 is an exemplary embodiment of the cable plug 110 and the lock body 1200 in a locked position with lock 1300. FIG. 16 is an exemplary embodiment of the cable plug 110 and lock body 1200 in an unlocked position with lock 1300.

The lock body 1200 includes a first body 1220 and a second body 1230. The first body 1220 surrounds the cable plug 110 with the second body 1230 surrounding the lock 1300.

The first body 1220 of the lock body 1200 has a first inside diameter larger than the outside diameter of the head 120. The first body 1220 also has a second inside diameter larger than the collar 130 and collar 160, but smaller than the first diameter, the diameter difference between the first diameter and the second diameter forming a lip 1224. The first body 1220 also has a third diameter larger than the outside diameter of stem 170 and smaller than the second diameter, the diameter difference between the second diameter and the third diameter forming a surface 1226. The first body 1220 further comprises an arm 1228, the arm 1228 extending away from the interior of the second body 1220 with the arm 1228 capable of being inserted into a standard slot in the outer wall of the computer (not shown). The second body 1220 further comprises an opening 1229, the opening 1229 extending into the second body 1220 along the same surface as the arm 1228. The area thus created in the opening 1229 is such that objects can be placed within the opening 1229 when in the unlocked state or prevented from escaping while the laptop lock 1000 is in a locked state.

The second body 1230 of the lock body 1200 is attached to or integral with the first body 1220, the second body 1230 having a first inside diameter larger than the outside diameter of the lock 1300.

The lock 1300 includes a body 1304 with a push button 1302 located at one end of the body 1304 and a detent 1306 located at another side of the body 1304. The lock 1300 is located such that the push button 1302 appears from the outside of the third body 1230 and the body 1304 and detent 1306 extend into the second diameter of the first body 1220. The lock 1300 is a standard locking device with a push button 1302 capable of moving in the detent 1306 along the B axis. In various exemplary embodiments, the second body 1230 has a second inside diameter less than the outside diameter of the body 1304 and greater than the outside diameter of the detent 1306, the difference between the first diameter and second diameter of the second body 1230 thus forming a lip 1232 in which the body 1304 of the lock 1300 rests.

As shown in FIGS. 15 and 16, the cable plug 110 is inserted into the lock body 1200. The cable plug 110 is restricted in its movement along the A axis by the surface 164 of the collar 160 coming into contact with the surface 1226 of the first body 1220. The cable plug 110 is also restricted along the A axis by the surface 162 of the collar 160 coming into contact with the body 1304 extending into the second diameter of the first body 1220.

As shown in FIG. 16, the laptop lock 1000 is in an unlocked state. The body 1304 is in contact with the surface 162 of the collar 160 and the detent 1306 is in contact with the surface 164 of the collar 160 so as to restrict axial movement of the cable plug 110 along the A axis.

When moving into a locked state as shown in FIG. 15, the lock 1300 is unlocked such that the push button 1302 is moved away from the cable plug 110. Consequently, the detent 1306 also moves away from the cable plug 110 so that the collar 160 can move within the second diameter of the first body 1220. The arm 1228 is inserted into a slot on the back wall of the computer. The cable plug 110 is then moved toward the first body 1220 along the A axis until the surface 164 of the collar 160 comes in contact with the surface 1226 of the first body 120. It should be appreciated that as the arm 1228 is inserted into a slot on the back wall of the computer, the opening 1229 is closed by the outer wall of the computer. It should also be appreciated that as the cable plug 110 moves towards the first body 1220, the spring 140 contracts as the movement of the spring 140 is limited by the lip 1224 and the surface 122 of the head 124 so as to create potential energy within the spring 140.

By closing the opening 1229, the laptop lock of the present invention can be used not only to secure the cables to the laptop housing, but can also be used to entrap cables, wires, and the like. Thus, for example, the laptop lock can be used to further secure computer equipment by entrapping a power cord, a peripheral cable, such as a monitor cable, a mouse cable, a printer cable, telephone cord or the like, within the closed opening 1229.

Once the surface 164 of the collar 160 comes in contact with the surface 1226 of the first body 1220, the push button 1302 is moved along the B axis such that the detent 1306 comes into contact with the surface 162 of the collar 160. Once the detent 1306 comes into contact with the surface 162 of the collar 160, the lock 1300 locks the detent 1306 in position such that the detent 1306 prevents the cable plug 110 from moving along the A axis.

When moving back to the unlocked state as shown in FIG. 16, an unlocking mechanism is applied to the lock 1306 such that the push button 1302 moves along the B axis. As the push button 1302 moves along the B axis, the detent 1306 moves away from the surface 162 of the collar 160. Once the detent 1306 moves away from the surface 162 of the collar 160, the potential energy stored in the spring 140 forces the cable plug 110 along the A axis. As the cable plug 110 moves along the A axis, the arm 1228 can be moved from the wall of the computer such that the closed opening 1229 is once again open. As such, the opening 1229 is created such that the objects can be removed from the opening 1229. The cable plug 110 moves along the A axis until the surface 162 of the collar 160 comes in contact with the body 1304 that extends into the second diameter of the first body 1220. Thereafter, the push button 1302 can be moved along the B axis such that the detent 1306 comes into contact with the surface of the collar 160 so as to restrict axial movement of the cable plug 110 along the A axis.

Furthermore, as should be appreciated, the area 202 or opening 650, 960 and 1229 found in the exemplary embodiments can be applied to any currently available or later developed locking apparatus that can be attached to a base. Thus, the area 202 or opening 650, 960 and 1229 can be applied to, for example, a Kensington type lock body.

While the present invention has been described with reference to a lock for a laptop computer, the invention is in no way limited to such an embodiment. Rather, the lock of the present invention can be used to secure any type of suitable equipment, whether it be electrical or computer equipment or not. Furthermore, the lock can be used to secure any suitable equipment that has, or can be modified so as to include, a suitable mounting means. Thus, for example, if the desired equipment does not have a security notch for attachment of the lock, it may be possible to create such a notch by appropriately cutting the equipment housing.

What is claimed is:

1. A locking system, comprising:

a locking apparatus comprising:

a plug comprising a first head;

a first collar connected to the first head with the first collar having an outside diameter smaller than the outside diameter of the head;

a first stem connected to the first collar with the first stem having an outside diameter smaller than the outside diameter of the first collar;

a second collar connected to the first stem with the second collar having an outside diameter greater than the outside diameter of the first stem; and a second stem connected to the second collar with the outside diameter of the second stem smaller than the outside diameter of the second collar;

a lock;

a housing for both the plug and the lock, the housing being shaped to restrict axial movement of the plug within the housing and the lock being shaped to prevent axial movement of the plug within the housing;

the housing comprising:

a first body with a first interior diameter larger than the head;

a second body with a second interior diameter larger than the head, a third interior diameter larger than the first and second collar and smaller than the second interior diameter, and a fourth interior diameter larger than the second stem and smaller than the third diameter;

a third body attached to the second body with a fifth interior diameter smaller than the outside diameter of the lock; and a cord entrapment attached to or integral with said housing for entrapping objects and locking the entrapped objects to the housing.

2. The locking system of claim 1, wherein the lock extends into the third diameter of the second body.

3. The locking system of claim 2, wherein axial movement of the plug is restricted when the second collar comes into contact with the lock.

4. The locking system of claim 2, wherein the lock comprises:

a body;

a push button at one end of the body; and a detent at the other end of the body connected to the push button, wherein axial movement of the detent and push button is prevented by the locking apparatus.

5. The locking system of claim 1, wherein the housing further comprises:

a first arm connected to the first body and extending away from the first interior diameter;

a second arm connected to the first arm and extending towards the second body; and a third arm connected to the second body and extending away from the second interior diameter, wherein the second arm comes into close proximity to the third arm when in the locked state.

6. The locking system of claim 1, further comprising:

a second head attached to the first head with the second head having an outside diameter larger than the interior diameter of the first body.

7. The locking system of claim 1, wherein the cord entrapment includes an opening that when the plug is in the housing, the opening is sized so as to permit a cord to move through the opening, but not to permit a connector at an end of the cord from moving through the opening.

8. A locking system comprising:

a housing having an opening therein and the opening extending along a housing main axis;

a plug in the housing opening, and the plug being moveable in the housing opening along the housing main axis between an outward position of the plug and an inward position of the plug;

a collar on the plug which is moveable with the plug;

a lock supported at the housing, the lock being moveable between a locked position, at which the lock is within the housing opening for engaging the collar of the plug as the plug is moved toward the outward position and for holding the plug at the inward position, and an unlocked position, at which the lock is far enough out of the housing opening to permit the collar to pass toward the outward position;

the lock has first and second separated abutments for engaging the collar, wherein the first abutment is positioned such that with the lock in the locked position, and the plug in the inward position, the first abutment engages the collar and retains the plug at the inward position; and the second abutment is positioned such that with the lock in the unlocked position, the second abutment engages the collar and holds the plug in the outward position.

9. The locking system of claim 8, further comprising a spring connected with the plug to normally urge the plug to the outward position thereof, the collar having a side thereof that is engaged by the lock to block outward movement of the first collar and the plug.

10. The locking system of claim 9, further comprising the spring extending between the plug and the housing to normally urge the plug to the outward position.

11. The locking system of claim 9, further comprising a surface in the housing positioned to be engaged by the plug upon movement of the plug into the housing, and the surface in the housing defining the inward position of the plug at which the plug is between the housing surface and the side of the first collar engaged by the lock.

12. The locking system of claim 8, wherein the lock is supported in the housing to move between the locked and unlocked positions along a second axis that crosses the housing main axis.

13. The locking system of claim 12, wherein the second axis is oblique to the first axis.

14. The locking system of claim 13, wherein the lock comprises a lock body and the lock body having a lower portion toward the housing opening, and the first abutment being disposed on the lower portion of the lock body; and the lock body having an upper portion that is further from the housing opening than the lower portion and the second abutment being disposed on the upper portion of the lock body.

* * * * *